United States Patent [19]

Iten

[11] Patent Number: 4,901,437

[45] Date of Patent: Feb. 20, 1990

[54] RAZOR HEAD AND METHOD OF MANUFACTURE

[75] Inventor: Clemens A. Iten, Staunton, Va.

[73] Assignee: American Safety Razor Company, Verona, Va.

[21] Appl. No.: 614,234

[22] Filed: May 25, 1984

[51] Int. Cl.[4] ..... B26B 21/00

[52] U.S. Cl. ..... 30/50

[58] Field of Search ..... 30/48–50, 30/32, 34.1, 90

[56] References Cited

U.S. PATENT DOCUMENTS

| | | | |
|---|---|---|---|
| 1,342,028 | 6/1920 | Nordskog . | |
| 1,455,674 | 5/1923 | Short . | |
| 1,670,309 | 5/1928 | McAbee . | |
| 2,342,558 | 2/1944 | Schjotz | 30/48 |
| 2,712,178 | 7/1955 | Marzio | 30/73 |
| 3,407,496 | 10/1968 | Pomper | 30/49 |
| 3,703,764 | 11/1972 | Perry | 30/32 |
| 3,777,396 | 12/1973 | Simonetti | 30/32 |
| 3,785,051 | 1/1974 | Dawidowicz | 30/40.2 |
| 3,786,563 | 1/1974 | Dorian | 30/50 |
| 3,810,305 | 5/1974 | Perry | 30/32 |
| 3,934,338 | 1/1976 | Braginetz | 30/50 X |
| 4,208,791 | 6/1980 | Van Cleve | 30/49 |

FOREIGN PATENT DOCUMENTS

| | | | |
|---|---|---|---|
| 517806 | 11/1918 | France | 30/49 |

*Primary Examiner*—Douglas D. Watts
*Attorney, Agent, or Firm*—Nixon & Vanderhye

[57] ABSTRACT

The invention relates to a razor head comprising a cap 26 having two elongated surfaces, each with longitudinal and lateral dimensions. One of the surfaces is curved. The razor head also has a platform 22 having elongated surfaces adapted to conform to those of the cap. A flexible curved shaving blade 28 and a pair of tandem straight shaving blades 30 and 32, each blade defining a plurality of locating holes are disposed between the cap and platform and are contained therebetween to conform to the elongated surfaces thereof. The cap also has a plurality of locating pins 34 and 36 extending therefrom to the platform through the holes defined by the blades. The pins have parallel axes. Pins 34, associated with the curved surface, are oriented at an angle to a plane normal to an axis of curvature of the curved surface of the cap. Both pins 34, and pins 36 associated with the straight blades, are oriented at an angle to a plane lying along the longitudinal dimension of and normal to the respective elongated cap surface to which they are attached. The above-described pin orientations provide close alignment tolerances perpendicular to the cutting edges of the blades, i.e., the lateral dimension, but allow some longitudinal dimension alignment gap parallel to the cutting edges, for ease of manufacture. Methods of manufacture are also disclosed.

9 Claims, 4 Drawing Sheets

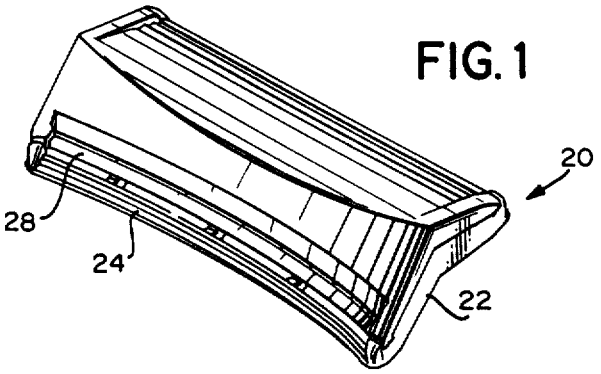
FIG. 1
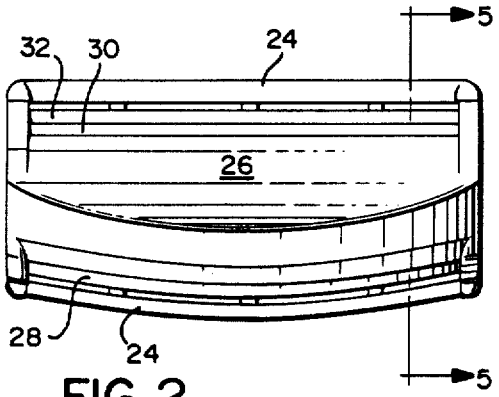
FIG. 2
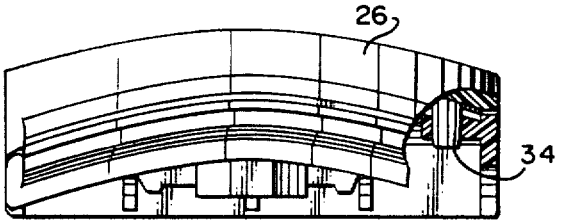
FIG. 3
FIG. 4
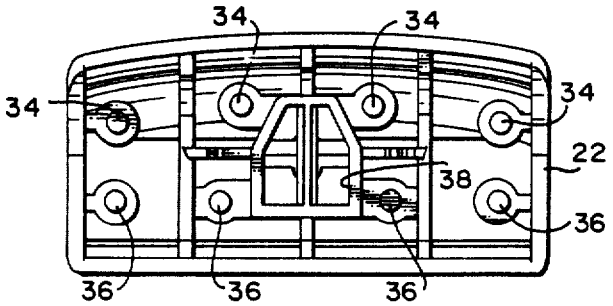

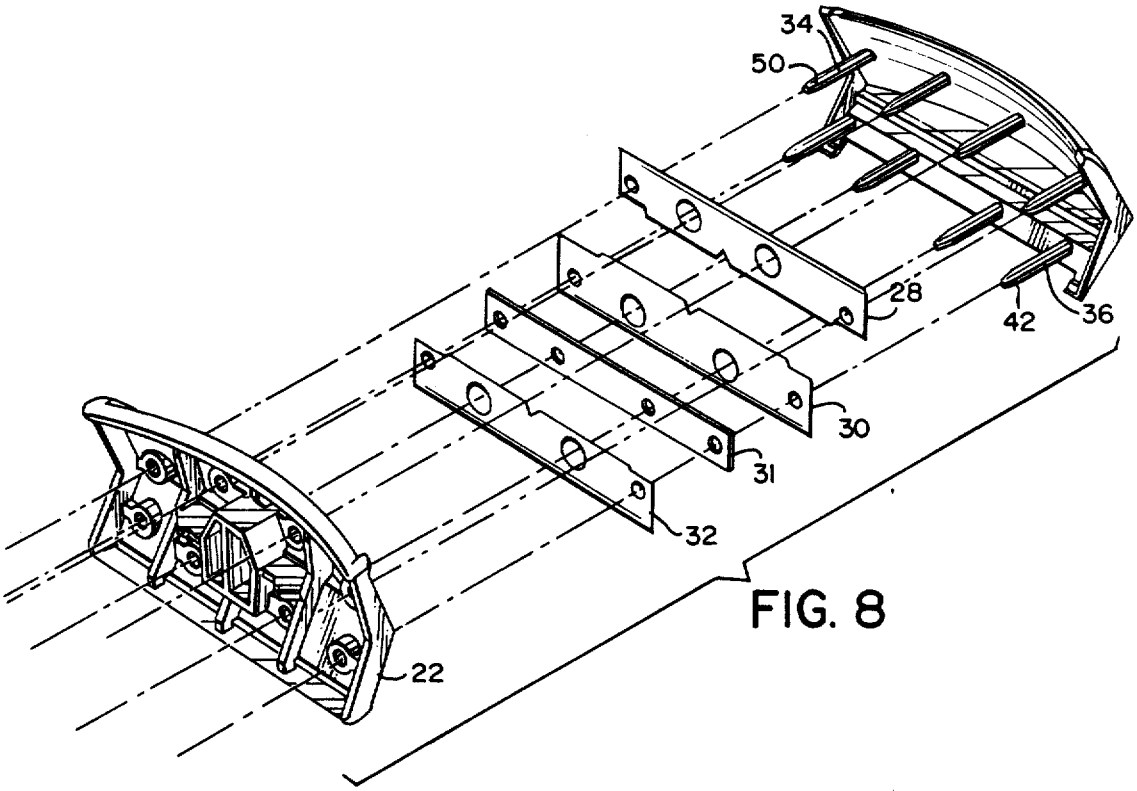
FIG. 8
FIG. 9
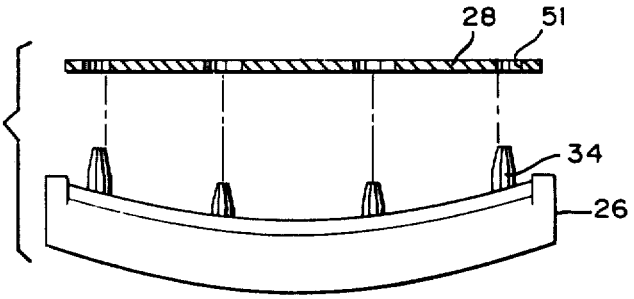
FIG. 10
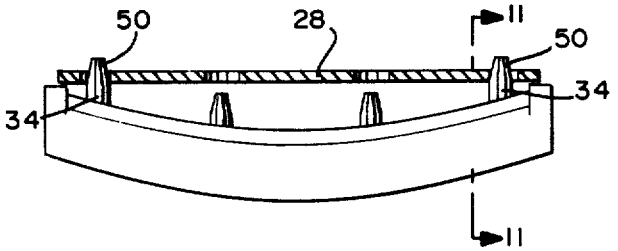

RAZOR HEAD AND METHOD OF MANUFACTURE

BACKGROUND OF THE INVENTION

The present invention relates generally to razors and more particularly to disposable safety razor heads having one or more blades mounted in a cartridge.

Advances in disposable blade, wet shaving systems have led to the prevalence of blades being attached to injection molded shaving cartridges, having shaving blades captured between cap and platform portions of the cartridge. These cartridges offer the advantage of precise angular and spatial tolerances relative to the soap bar portion of the platform, in order to obtain optimum shaving results. During manufacture, detailed procedures are undertaken to ensure maintenance of optimal angles and blade depths relative to the cartridge soap bar.

Two tolerances that are important to maintain during cartridge manufacture are the angle of the shaving blade relative to the soap bar and the lateral distance, perpendicular to the blade cutting edge, between the blade and the soap bar. The precision angular alignment is normally maintained by defining an elongated surface on the platform portion of the shaving cartridge that also contains the soap bar. Maintenance of the lateral distance between the blade and soap bar is usually accomplished by relatively precise alignment techniques.

One alignment technique for maintaining the lateral distance between the blade and soap bar involves assembling the cartridges in a jig that maintains the proper spatial relationship between the blade and soap bar. This is usually accomplished by restraining the platform in a jig, placing the blade on the platform in alignment with another portion of the jig and installing the cap on top of the nested blade and platform, so as to capture the blade therebetween. The cap and platform are then bonded to capture the blade permanently. Utilization of assembly jigs complicates manufacture and increases costs. In order further to ensure blade capture, the platform or the cap, or both, often contain locating pins that pass through holes defined by a shaving blade.

Another way of ensuring proper lateral alignment between the soap bar and the blade involves precisely casting the locating pins on either the cap and/or the platform to mate very closely with the blade holes so as to ensure proper lateral alignment. However, all components must then be manufactured to relatively high precision tolerances, which raises manufacturing costs. Rather than attempting to maintain extremely precise manufacturing tolerances in the platform and cap, manufacturers have attempted to effect a compromise by ensuring very precise lateral tolerances in the dimension perpendicular to the blade cutting edge while allowing lateral freedom parallel to the blade cutting edge.

One solution that has been attempted for precise lateral alignment, but with longitudinal freedom, has been to manufacture the platform and cap locating pins with elliptical cross-sections such that the major axis of each elliptical cross-section pin is positioned perpendicular to the blade cutting edge and the minor axis is positioned parallel to the blade cutting edge. The holes defined by the razor blade for passage of the locating pins therethrough are then cut in a circular shape that closely approximates the locating pin major axis diameter. In this manner, precise alignment perpendicular to the cutting edge is maintained, yet a small amount of lateral spacing accommodates small variations in manufactured components.

It is more difficult for a tool and die maker to manufacture molds for elliptical cross-section pins rather than circular cross-section pins, which leads to higher manufacturing costs for molds, and so ultimately for the razor head cartridges. The problems associated with cost effective precision alignment of razor blades within razor head cartridges has also inhibited product development in new areas. There is also a recognized need and desire to purchase disposable razor heads having a convex blade for easier and safer shaving of concave portions of the body, such as underarm areas.

In the past, razor heads have been designed with convex-shaped razor cutting edges, such as U.S. Pat. Nos. 1,342,028, issued on June 1, 1920 and 1,670,309, issued on May 22, 1928. The disclosures of these patents represent a previous generation of razor design wherein a disposable, flexible blade is captured by upper and lower portions that in turn mate with a screw-in handle portion. Razor heads and blades of this nature have generally been superseded by disposable cartridge razor heads because the former do not maintain precise angular relation and lateral positioning of the blade cutting edge, which in turn leads to less close shaves and greater danger of accidental shaving nicks. So far, there have been no commercially successful disposable cartridge head razor systems having curved cutting blades because of difficulties encountered in positioning a blade within a curved cap and platform as well as blade alignment problems associated therewith.

SUMMARY OF THE INVENTION

It is an object of the present invention to create precision blade alignment means within a disposable razor head cartridge that allows easy, precise lateral alignment of the razor blade perpendicular to the cutting edge, but that allows alignment freedom during manufacture in the longitudinal parallel direction perpendicular to the cutting edge.

It is another object of the present invention to design a disposable razor head cartridge having a cutting blade that assumes a curved, convex configuration for shaving concave portions of a user's body, such as an underarm, yet that also maintains precise lateral alignment.

It is another object of the present invention to develop a method of manufacturing razor cartridges that allows precise but inexpensive lateral alignment of blades yet that allows for longtudinal alignment variation parallel to the cutting edge.

The present invention features a razor head providing a cap having a elongated surface with longitudinal and lateral dimensions, a platform having a elongated surface adapted to conform to the elongated surface of the cap, and a shaving blade, having a cutting edge, that defines a plurality of locating holes. The blade is disposed between the cap and the platform and is contained therebetween to conform to the elongated surfaces. A plurality of locating pins extend from one of the cap and platform elongated surfaces to the other through the holes in the blade. The pins have parallel axes oriented at an angle to a plane lying along the longitudinal dimension of and normal to the elongated surface from which the pins extend. The pins can be constructed with a circular cross-section and the holes in the blade can also be of a circular cross-section of a diameter slightly greater than the diameter of the locating pins.

As a further feature of the invention, the razor head can comprise a cap having an elongated curved surface and a platform having an elongated curved surface adapted to conform to the curved surface of the cap. A flexible shaving blade defining a plurality of locating holes is disposed between the cap and the platform and is contained therebetween to conform to the curved surfaces. A plurality of locating pins extends from one of the cap and platform curved surfaces to the other, through the holes in the blade. The pins have parallel axes oriented at an angle to a plane normal to an axis of curvature of the curved surfaces of the cap and platform, which plane also lies along the longitudinal dimension and normal to the curved surface.

By maintaining the above-described parallel pin orientation at an angle to a plane normal and along the longitudinal dimension of the elongated surfaces, the pin cross-section, parallel to the blade, where the pins pass through the blade holes is elliptical and the major axis of the cross-sectional ellipse run generally perpendicular to the blade cutting edge, i.e., in the lateral dimension of the elongated surfaces, whereas the minor axis runs generally parallel to the blade cutting edge, i.e., in the longitudinal dimension of the elongated surfaces. If the holes defined by the blade are sized so as to be relatively close to the pins' major axes, precise lateral alignment of the blade and cartridge, perpendicular to the blade cutting edge is maintained, whereas longitudinal alignment freedom is maintained parallel to the blade cutting edge. Thus, precise blade alignment may be achieved on an inexpensive basis for both curved and straight blade disposable razor head cartridges. A cartridge may also be designed having a curved blade construction on one portion and one or more straight blades on another portion.

The present invention also relates to a method of manufacturing a razor head by grasping a cap having an elongated surface, with longitudinal and lateral dimensions, and a plurality of locating pins extending from the cap surface. The pins have parallel axes oriented at an angle to a plane lying along the longitudinal dimension of and normal to the elongated surface from which the pins extend. A plurality of locating holes defined by a flexible shaving blade are then laterally aligned with the cap locating pins. A platform, having an elongated surface adapted to the elongated surface of the cap, is laterally aligned with said cap.

The cap and platform are biased together so as to capture the shaving blade therebetween and the cap is attached to the platform.

With this simplified manufacturing technique, it is also possible to align a multitude of blades simultaneously on the same cartridge during manufacture, so as to minimize required production machinery and manufacturing time per razor head unit. It is also possible to manufacture a combination razor head having a curved blade on one side and one or more straight blades on the other side.

A method of manufacturing a razor head having both curved and straight blades is also disclosed. A cap having an elongated curved surface having longitudinal and lateral dimensions is grasped. The cap has a first plurality of locating pins extending from the cap curved surface at an angle to a plane lying along the longitudinal dimension of and normal to the curved surface. The cap also has an elongated flat surface having longitudinal and lateral dimensions. A second plurality of locating pins extend from the elongated flat surface at an angle to a plane lying along the longitudinal dimension of and normal to the flat surface. A plurality of locating holes defined by a first shaving blade are laterally aligned with which the second set of pins and the first blade is inserted thereon.

Next, a plurality of locating holes defined by a spacer are laterally aligned with the second set of pins and the spacer is inserted thereon. A plurality of locating holes defined by a second shaving blade is laterally aligned with the second set of pins whereupon the second blade is inserted thereon. The manufacture next involves laterally aligning a plurality of locating holes defined by a third shaving blade with the first set of pins and inserting the third blade thereon. A platform, having elongated curved and flat surfaces adapted to conform to said elongated surfaces of the cap is laterally aligned with the cap, whereupon the cap and platform are biased together so as to capture said blades therebetween. Finally, the cap is attached to the platform.

As an alternative method to that previously recited, the third blade may be aligned and inserted prior to alignment and insertion of the second blade.

In yet another alternative, the second and third blades ae simultaneously aligned and inserted prior to platform alignment.

The present invention offers the advantages of precise blade alignment at a reduced cost, through use of a simplified manufacturing process. The present invention also allows the creation of a curved blade shaving cartridge that also ensures precise blade alignment by a simplified, inexpensive manufacturing process.

BRIEF DESCRIPTION OF THE DRAWINGS

A better understanding of the invention may be had by reference to the drawings, forming a portion of the present disclosure wherein:

FIG. 1 is a front top perspective view of a shaving cartridge constructed in accordance with the teaching of the present invention;

FIG. 2 is a top view thereof;

FIG. 3 is a front view thereof and partial section showing a curved razor blade with a locating pin passing therethrough;

FIG. 4 is a bottom view thereof;

FIG. 8 is an exploded view of a preferred embodiment of a razor head constructed in accordance with the teachings of the present invention;

FIG. 9 is a front elevational view of a curved blade portion of a shaving cap showing alignment of a blade with the locating pins of the cap during assembly;

FIG. 10 is a view similar to that of FIG. 9 after the blade has been located on the cap pins;

DESCRIPTION OF THE PREFERRED EMBODIMENTS

Figure 5:
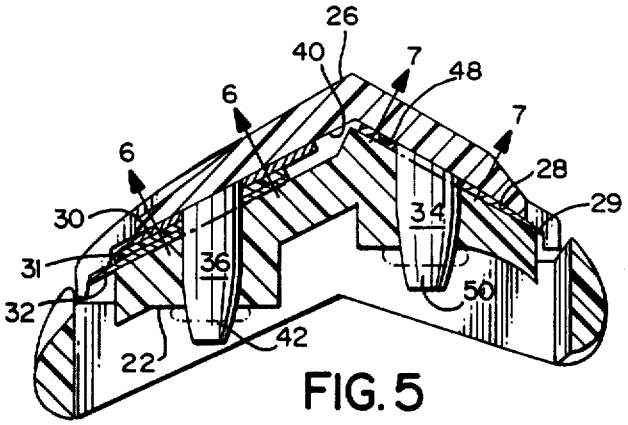
FIG. 5 is a lateral cross-section taken through line 5—5 of FIG. 2.

Referring to the drawings, FIGS. 1 and 2 show a razor head 20, having a platform 22 with soap bars 24 that ride against the skin of a user. The razor head 20 also has a cap 26. A curved blade 28 whose cutting edge assumes an arcuate curved profile is retained between the platform 22 and cap 26. The curved blade 28 profile may be of a constant radius or any desired compound curve configuration, having a multitude of centers of curvature. As can be appreciated, the center of curvature can be measured perpendicularly to the edge of blade 28 along any portion thereof.

As shown in the preferred embodiment, the razor's head also has a pair of tandemly mounted straight blades 30 and 32 opposite the curved blade 28. In this manner, this same razor head has both a curved blade for shaving concave surfaces, such as underarms, and a straight blade cutting surfce for other parts of the body, such as the face or legs.

A plurality of locating pins 34 extend from one of the cap 26 and platform 22 to the other through holes defined by the blade, one of which is shown in FIG. 3. The pins 34 are preferably attached to the cap 26. At least two pins should be used to retain each shaving blade, but in a preferred embodiment, four pins are used and pass through holes defined by the platform 22. The pins 34 are utilized on the straight blades. The pins 34 and 36 may be advantageously utilized to attach the cap 26 to the platform 22. In the preferred embodiment, the ends of the pins are staked to a flat head configuration in order to prevent separation of the platform 22 from the cap 26. It is contemplated that other forms of attachment may be utilized, such as adhesives, heat welding, or any other bonding means known to those reasonably skilled in the art.

As shown in FIG. 4, the platform 22 defines a cavity 38 adapted for receipt of a razor handle connector. It is contemplated that any means for connecting the razor head 20 to a handle can be utilized and those that allow selective attachment and detachment thereof are considered to be most advantageous. However, it is also contemplated that a handle could be permanently attached to the razor head 20.

The construction of locating pins 34 and 36 is shown in greater detail in cross-sectional FIG. 5. Referring first to the tandem, straight portion of the cartridge, cap 26 has an elongated surface 40 having a longitudinal dimension generally parallel to the blade cutting edge and a lateral dimension generally perpendicular to the blade cutting edge. The pins 36 project from the elongated surface 40 and all have parallel center line axes that intersect a plane running along the longitudinal dimension and normal to the elongated surface. A suitable angle of inclination is about 65°. First straight blade 30 rests upon, and conforms to the elongated portion 40 which defines a flat plane. A spacer bar 31 is stacked upon blade 30 and also defines holes through which pass the locating pins 36. The second straight blade 32 rests upon the spacer bar 31, thereby forming the straight tandem blade construction feature of the razor head. Locating pin 36 has a tapered end portion 42 for easy alignment of a blade hole therewith. As can be clearly seen, the pins 36 are inclined at an angle relative to elongated portion 40 of cap 26 and thereby to the cutting edges of blades 30 and 32. It is also readily apparent that, in the particular construction shown, the angle of inclination of the locating pin 36 centerlines would intersect a plane normal (i.p. perpendicular) and lying parallel to the cutting edges of blades 30 and 32.

Figure 6:
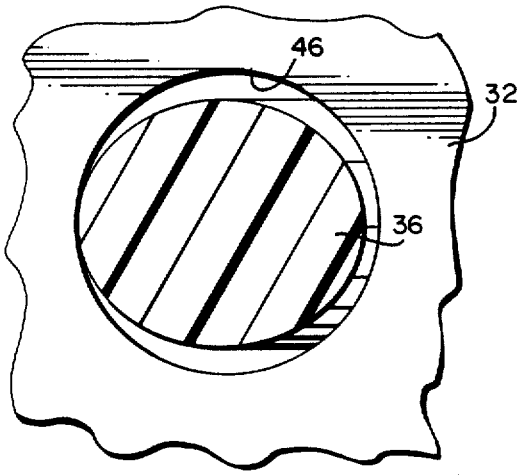
FIG. 6 is a plan section of a locating pin taken along line 6—6 of FIG. 5, which is parallel to the surface of a shaving blade.

The advantages of the angled orientation of the locating pins 36 relative to the blades in the direction perpendicular to the cutting edges is most apparent in FIG. 6. In FIG. 6, the dimension appearing left to right in the drawing is perpedicular to the cutting edges of either blade 30 or 32 and the dimension from top to bottom is parallel thereto. A section taken through any of the locating pins 36, parallel to the cap elongated portion 20, near either of the blades 30 and 32, would appear elliptical in cross-section, with the major axis perpendicular to the blade cutting edge and minor axis parallel thereto. By suitable dimensioning of the holes 46 defined by blade 30 or 32 a close tolerance fit can be realized in the lateral dimension, perpendicular to the blade cutting edge, and a relatively loose fit can be realized parallel to the blade cutting edge. In this manner, close tolerances can be maintained in the dimension laterally to the cutting edge, which is the desired result, and alignment clearance may be had perpendicular to the cutting edge, which is also desired. Concurrently therewith, round pins offer the advantage of easier mold manufacturing, if the cap and platform are to be manufactured of the prevalent molded plastic.

Referring back to FIG. 5, the locating pins 34 of the curved blade portion of cap 26 project from an elongated curved portion 48 of the cap. The elongated curved portion 48 has a longitudinal dimension and a lateral dimension and is defined by a radius and a center of curvature, the former being perpendicular to the curvature. Elongated curved portion 48 need not have a constant radius of curvature and if desired, it can vary in the longitudinal dimension. For ease of manufacture it is preferred that the radius of curvature be constant, even more preferably that the radius be between 1.5 and 3 inches. Elongated pins 34 also have a tapered end 50 for easy alignment of the curved blade 28. The centerline axes of the locating pins 34 are parallel and intersect at a angle a plane perpendicular to an axis of curvature perpendicular to the plane of the blade at the center of curvature of the elongated curved portion 48. For example, in FIG. 5, the axis of curvature would generally run along the drawing sheet and the plane normal thereto would project generally perpendicularly from the drawing. A preferred angle of intersection between the pin centerline axis and a plane normal to the axis of curvature is about 65°.

Figure 7:
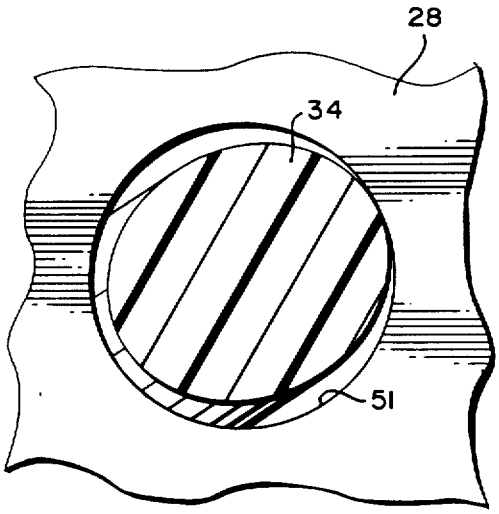
FIG. 7 is a section similar to that of FIG. 6, taken along line 7—7 of FIG. 5.
Figure 6A:
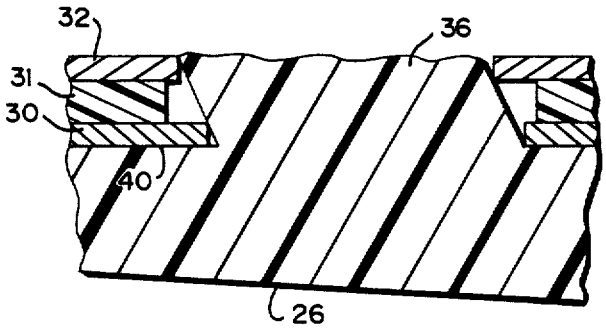

FIG. 7 shows that a cross-section of locating pin 34 taken parallel and at the surface of the blade 28 is elliptical with the major axis thereof running generally perpendicularly to the blade cutting edge and the minor axis running generally parallel thereto. Due to the geometry of the blade construction, it is apparent that the major axis is not perfectly perpendicular to the blade cutting edge because the intersection of the blade 28, hole 51 as conformed to the curved elongated surface 48, and the locating pin 34 is that of an inclined cylindrical arc intersecting the tapered cylindrical pin.

FIG. 8 shows an exploded view of all of the components in the preferred embodiment of the razor head cartridge wherein there is a curved blade on one portion of the razor head and a tandem pair of straight razor blades opposite the curved blade. In this embodiment, the locating pins 34 and 36 all have parallel centerline axes, which facilitates easier assembly of the cartridges. That of all of the locating pins 34 and 36 are parallel allows to assemble both sets of shaving blades simultaneously on the same assembly line.

The assembly process commences by grasping a cap 26 having the plurality of parallel locating pins 34 and 36 as has been previously described. The manufacturing process continues by laterally aligning a plurality of locating holes defined by one or more of the flexible shaving blades with the appropriate cap locating pins. For convenience, only the alignment of the curved blade 28 with the locating pins 34 will be described in detail, but it should be understood that similar alignment steps are performed on the straight blades 30 and 32, as well as the spacer 31.

Referring to FIG. 9, the locating holes 51 defined by blade 28 are axially aligned with the locating pins 34. As has been previously described above, any number of locating pins may be used for actual location of the blade, but in the preferred embodiment only the two pins at the extreme longitudinal ends are actually utilized for precision alignment of the blade relative to the cap 26. Next, the curved blade 28 is placed over the end locating pins 34 closest to the ends of the cartridge, as shown in FIGS. 10 and 11.

Due to the geometry of the blade 28 and cap 26, the outboard pins 34, i.e., the closest to the ends of the cap 26, do not coaxially align with the holes 51 defined by blade 28. Rather, they eccentrically favor the inboard edges of the holes 51, i.e., the edges closest to the longitudinal center of the cap 26 as shown in FIG. 10. Kinematics of the blade conformity to the shape of the cap's elongated curved surface 48 mandate such an alignment, so that the blade, in its final conformed shape, shown in FIG. 12, will maintain proper alignment with the locating pins.

Figure 11:
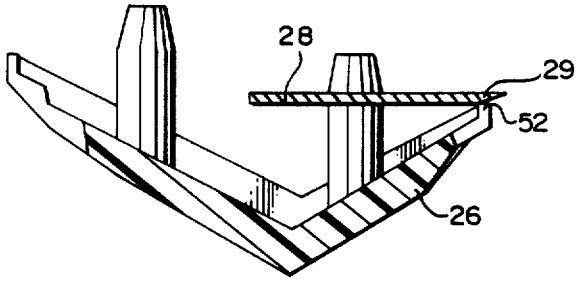
FIG. 11 is a side sectional plan view taken along line 11—11 of FIG. 10.

In FIG. 11, it is also apparent that the cutting edge 29 of blade 28 rests upon a ledge 52 defined by the cap 26. This prevents blade 28 from tipping out of alignment during the manufacture process prior to conforming the blade to the curved shape of elongated surface. Those skilled in the razor cartridge manufacturing art will appreciate that blade tipping relative to the cap, prior to complete assembly of the razor cartridge, might jam assembly machinery. It is also preferred that the outboard locating holes 51 be designed in the blade such that they favor the heel edge of the blade 28, i.e., the unsharpened edge parallel to the cutting edge 29, so that the center of gravity of the blade will tend to cause it to tip into contact with ledge 52 after the blade is dropped upon the locating pins 34. This ensures that the blade 28 will not tip backwards into the gap between the parallel sets of locating pins 34 and 36, which could also jam assembly machinery.

Figure 12:
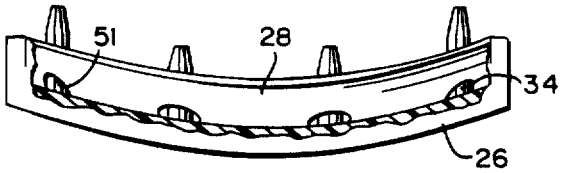
FIG. 12 is a partial sectional plan view similar to that of FIG. 9 after the cutting blade has been conformed to the curved shape of the cap.

After the curved blade 28 has been placed upon locating pins 34 such that the portion closest to the cutting edge 29 rests upon edge 52, the blade is conformed to the curved shape of the elongated curved portion of cap 26, as shown in FIG. 12. Conformity may be accomplished by two means; the blade 28 can be pushed by an external biasing member into the bowed, conformed shape or alternatively the platform portion (not shown) may be axially aligned with the locating pins 34 and the platform itself can be used as the biasing member as the platform and cap are laterally joined together.

If the platform is used as the biasing member, it should be understood that there is some chance that plastic may be shaved off pin 34. Any plastic shavings falling between components may act as spacers and thus may prevent proper assembly of the cap, platform and blades into a completed cartridge. After blade 28 is placed on the locating pins, and if desired, conformed to the curved shape, platform 22 is laterally aligned with the locating pins, whereupon both portions are biased together in order to squeeze the blades therebetween. Lastly, the cap 26 and platform 22 are bonded together as previously described, such as by heat welding the locating pins. The cartridge is now completed.

In the preferred embodiment of the shaving cartridge, there are both curved and straight shaving blades and thus the additional straight shaving blades are also aligned with the cap 26 prior to aligning the platform 22 therewith.

The preferred means of manufacturing the preferred cartridge construction is by aligning and inserting the first tandem blade 30 over locating pins 36 followed by the spacer 31. At this point, the second tandem blade 32 may be aligned with pins 36 or the curved blade 28 may be aligned with the pins 34 prior to alignment of the second tandem blade 32. It is also possible to align curved blade 28 prior to alignment of the second tandem blade 32, or for that matter it is possible to align simultaneously both straight tandem blade 32 and the curved blade 28. After alignment of the second tandem blade 32 and curved blade 28, by whatever chosen alignment sequence, the curved blade 28 may be conformed to the bowed, curved shape by an external biasing means. If an external biasing means is not desired, platform 22 is aligned with cap 26 over the locating pins 34 and 36 and both are biased together with the blades therebetween. The cap and platform are then attached to each other by any appropriate attaching mens, such as by staking the ends of the locating pins 34 and 36 into a mushroomed rivet-like shape.

In as much as the present invention, both the razor head construction and methods of manufacture thereof is subject to many variations, modifications and changes in detail, it is intended that all matter contained in the foregoing description or showing in the accompanying drawings shall be interpreted as illustrative and not in a limiting sense.

What is claimed is:

1. A razor head, comprising:

a cap having an elongated longitudinally curved surface;

a platform having an elongated longitudinally curved surface adapted to conform to the curved surface of said cap;

a flexible shaving blade defining two locating holes having centers separated along the surface of the blade by a first predetermined distance, said blade being disposed between said cap and said platform and being contained therebetween to conform to said curved surfaces thereof; and two locating pins extending from one of said cap and platform curved surfaces to the other through the holes in said blade, said pins having parallel axes oriented at a non-zero angle to a plane normal to an axis of curvature of said curved surface from which said pins extend, said axes of said pins being separated by less than said first predetermined distance.

2. The razor head as recited in claim 1 wherein said elongated curved surfaces have a constant radius of curvature.

3. The razor head as recited in claim 1 wherein said pins have a circular cross-section.

4. The razor head as recited in claim 3 wherein the holes defined by said blade have a diameter greater than the diameter of said locating pins.

5. The razor head as recited in claim 1 wherein said platform has means for selective attachment of said razor head to a razor handle.

6. The razor head as recited in claim 1 further comprising at least one additional shaving blade disposed thereon.

7. The razor head as recited in claim 6 wherein two of said additional shaving blades are tandemly mounted with a spacer therebetween.

8. The razor head as recited in claim 1 wherein a plurality of locating holes is defined by one of said cap and platform elongated surfaces, said additional locating holes being adapted for receipt of said locating pins of the other.

9. A razor head, comprising:

a cap having an elongated curved surface with a constant radius of curvature and an elongated flat surface, each surface having longitudinal and lateral dimensions;

a platform having an elongated curved surface with a constant radius or curvature adapted to conform to the curved surface of said cap and an elongated flat surface adapted to conform to the flat surface of said cap;

a first flexible shaving blade defining two round cross-sectional locating holes having centers separated along the surface of the blade by a first predetermined distance, disposed between said cap and said platform curved surfaces and being contained therebetween to conform to said curved surfaces thereof;

second and third shaving blades, each defining a plurality of locating holes, said second and third blades being tandemly disposed with a spacer therebetween, between said cap and said platform flat surfaces and being contained therebetween to conform to said flat surfaces thereof;

two first locating pins extending from one of said cap and platform curved surfaces to the other through the holes defined by said first blade, said first pins having a circular cross-sectional diameter smaller than the diameter of the holes defined by said first blade and parallel axes oriented at a non-zero angle to a plane normal to an axis of curvature for said curved surface from which said first pins extend, said axes of said pins being separated by less than said predetermined distance; and a plurality of second locating pins extending from one of said cap and platform flat surfaces to the other through the holes in said second and third blades, said second pins having a circular cross-sectional diameter smaller than the diameter of the holes in said second and third blades and parallel axes oriented at an angle to a plane lying along said longitudinal dimension of, and normal to said flat elongated surface from which said second pins extend.

* * * * *